United States Patent [19]

Willer et al.

[11] Patent Number: 5,028,283

[45] Date of Patent: Jul. 2, 1991

[54] IONOMER BASED HIGH-ENERGY COMPOSITIONS

[75] Inventors: Rodney L. Willer, Neward, Del.; James A. Hartwell, Elkton, Md.

[73] Assignee: Thiokol Corporation, Ogden, Utah

[21] Appl. No.: 474,676

[22] Filed: Feb. 6, 1990

Related U.S. Application Data

[63] Continuation of Ser. No. 294,329, Jan. 6, 1989, abandoned.

[51] Int. Cl.[5] ..... C06B 45/10

[52] U.S. Cl. ..... 149/19.1; 149/19.9; 149/19.91

[58] Field of Search ..... 179/19.1, 19.9, 19.91

[56] References Cited

U.S. PATENT DOCUMENTS

| | | | |
|---|---|---|---|
| 3,498,855 | 3/1970 | Harris | 149/19.91 |
| 3,586,552 | 6/1971 | Potts et al. | 149/19.91 |
| 3,642,728 | 2/1972 | Canter | 260/79.3 R |
| 3,836,511 | 9/1974 | O'Farrel et al. | 260/79.3 R |
| 3,870,841 | 3/1975 | Makowski et al. | 260/23.7 R |
| 4,099,376 | 7/1978 | Japs | 149/19.9 |
| 4,184,988 | 1/1980 | Makowski et al. | 260/23.5 A |
| 4,361,526 | 11/1982 | Allen | 264/3 C |

OTHER PUBLICATIONS

J. P. Kennedy et al., *ACS Org. Coat. Appl. Polym. Sci. Pro.*, 46 182 (1982).

Y. Mohajer et al., *Polym. Bull.* 8, 47 (1983).

S. Bagrodia et al., *J. Appl. Polym. Sci.*, 29 (10), 2065 (1984).

*Primary Examiner*—Edward A. Miller

*Attorney, Agent, or Firm*—Ronald L. Lyons; Parmelee, Bollinger & Bramblett

[57] ABSTRACT

Propellants have high energy particulates dispersed in a binder system based upon thermoplastic elastomeric ionomers. In addition to the ionomer, the binder system has an ionolyzer which melts at processing temperatures and facilitates relative movement of ionic segments of the ionomer, plus a plasticizer for hydrophobic, amorphous segments of the ionomer.

12 Claims, No Drawings

IONOMER BASED HIGH-ENERGY COMPOSITIONS

This is a continuation of copending application Ser. No. 07/294,329 filed on Jan. 6, 1989 now abandoned.

The present invention is directed to high-energy compositions, such as propellants, explosives, gasifiers and other pyrotecnics, having a binder system which is based upon thermoplastic, elastomeric ionomers.

BACKGROUND OF THE INVENTION

Solid high-energy compositions, such as propellants, explosives, gasifiers, or the like, comprise solid particulates, such as fuel particulates and oxidizer particulates, dispersed and immobilized throughout a binder matrix comprising an elastomeric polymer.

Conventional solid composite propellant binders utilize cross-linked elastomers in which prepolymers are cross-linked by chemical curing agents. As outlined in detail in U.S. Pat. No. 4,361,526, there are important disadvantages to using cross-linked elastomers as binders. Cross-linked elastomers must be cast within a short period of time after addition of the curative, which time period is known as the "pot life". Disposal of a cast, cross-linked propellant composition is difficult, except by burning, which poses environmental problems. Furthermore, current state-of-the-art propellant formulations have serious problems that include, but are not limited to, use of nonenergetic binders, high end-of-mix viscosities, thermally labile urethane linkages, and extreme vulnerability to unscheduled detonation.

In view of inherent disadvantages of cross-linked elastomeric polymers as binder matrices, there has been considerable interest in developing thermoplastic elastomers suitable as binder matrices for solid, high-energy composition. However, many thermoplastic elastomers fail to meet various requirements for propellant formulations, particularly the requirement of being processible below about 120° C., it being desirable that a thermoplastic polymer for use as a binder in a high-energy system have a melting temperature of between about 70° C. and about 120° C. Many thermoplastic elastomers exhibit high melt viscosities which preclude high solids loading and many show considerable creep and/or shrinkage after processing.

The present invention is directed to high-energy compositions having binder systems that are based upon telechelic polymers that exhibit thermoplastic elastomeric characteristics.

U.S. Pat. No. 3,870,841, the teachings of which are incorporated herein by reference, is directed to polystyrene which is randomly sulfonated. U.S. Pat. Nos. 3,642,728 and 3,836,511, the teachings of which are also incorporated herein by reference, are directed to the sulfonation of ethylene-propylene-diene rubber (EPDM) at the diene-derived unsaturations which are present at random points along the polymer chain. The ionic sulfate moieties tend to aggregate at lower temperatures, which aggregation is destroyed at higher temperatures, whereby these polymers exhibit thermoplastic characteristics. The processes described in these patents yield polymer molecules consisting of two nonfunctional hydrocarbon chain ends, and one or more elastically effective inner segments which are bounded by the ionic moieties. The topology of the network derived from sulfonate aggregation, regardless of the average number of ion pairs which participate in an aggregate, is such that no covalent branch points exist, and each primary polymer chain contributes two dangling, nonload-bearing ends. If a polymer chain is sulfonated at only one point, it contains no inner segments and cannot participate in the load-bearing function. Because of these limitations, the molecular weight of the primary polymer chains, and the level of sulfonation, must be sufficiently high to develop adequate toughness and strength, and this results in undesirably high melt viscosities.

Star-branched, low molecular weight, telechelic ionomers have been shown to make excellent thermoplastic elastomers with very low melt viscosities; J. P. Kennedy, et al., *ACS Org. Coat. Appl. Polym. Sci. Pro.*, 46 182 (1982), Y. Mohajer, et al., *Polym. Bull.*, 8, 47 (1983), and S. Bagrodia, et al., *J. Appl. Polym. Sci.*, 29 (10), 3065 (1984). These works deal with polyisobutylene (PIB)-based ionomers. The covalent branch point of the star dramatically increases ionomer network connectivity. Because the ionic groups are placed only at the chain ends, the network is free of non-load-bearing chain ends.

Additional thermoplastic ionomers are described in a U.S. patent application of Robson F. Storey and Scott E. George entitled "Star-Branched Thermoplastic Ionomers" filed on Jan. 6, 1989 as Ser. No. 07/294,320now allowed the teachings of which are incorporated herein by reference.

Ionomers have important potential advantages relative to other types of thermoplastic elastomers for use as binders in high-energy formulations. In particular, ionomers provide much better mechanical stability relative to conventional thermoplastic elastomers which generally have alternating amorphous and crystalline blocks, the amorphous blocks providing elasticity and the crystalline blocks of different polymer molecules forming a physical interlock to give structure to the elastomer. Conventional thermoplastic elastomers have been shown to be effective propellant binders in small scale rocket motors. However, there appears to be a limit to the size of rocket motors which can be constructed with propellants based on conventional thermoplastic elastomers. The physical interlock provided by the crystalline blocks of conventional thermoplastic elastomers tend to give way when subjected to the compressive stress of the great weight of large rocket motors, causing the polymer molecules to slide relative to each other and thereby allowing the propellant to flow and distort. Ionomers, in contrast, rely not on a mechanical interlock, but on ionic interaction between polymer molecules. This interaction is much stronger than the mechanical interlock in conventional thermoplastic elastomers; thus, ionomers hold the promise of being much more suitable than conventional thermoplastic elastomers for large rocket motors. At the same time, ionomers exhibit thermoplastic, elastomeric characteristic, providing advantages inherent in conventional thermoplastic elastomers relative to cross-linked elastomers.

Despite the recognized potential of ionomers as the basis for binder systems in high-energy compositions, attempts to produce ionomer-based high-energy formulations in a practical manner have been limited by processing difficulties. In particular, ionomer-based propellant formulations have proven to be too viscous to process in conventional mixing apparatus, such as sigma blade mixers, or in conventional extrusion apparatus.

It is a general object of the invention to provide high-energy formulations having solid particulates in an ionomer-based binder system, which high-energy formulations are castable and extrudable.

SUMMARY OF THE INVENTION

High-energy compositions are provided containing between about 70 and about 90 weight percent of high-energy particulates, including oxidizer particulates and/or fuel particulates, plus between about 10 and about 30 weight percent of a binder system based upon a thermoplastic, elastomeric ionomer. The ionomer comprises between about 20 to about 50 weight percent of the binder system or between about 2.0 to about 15 weight percent of the high-energy composition. The binder system further comprises an ionolyzer having a melting temperature between about 70° C. and about 120° C. and a hydrophobic plasticizer. The ionolyzer comprises between about 2.5 and about 20 weight percent of the binder system or between about 0.25 and about 6 weight percent of the high-energy composition; the plasticizer comprises between about 40 and about 80 weight percent of the binder system or between about 4 and about 24 weight percent of the high-energy composition as a whole. The ionolyzer in molten state facilitates dissociation of the ionic interactions between ionomer molecules, reducing the viscosity of the propellant composition during mixing, casting or extrusion. The plasticizer interacts with hydrophobic, amorphous segments of the ionomer, further facilitating flow of the molten high-energy composition.

DETAILED DESCRIPTION OF THE INVENTION

In accordance with the present invention, a high-energy composition, particularly a propellant for a rocket motor or the like, comprises a high percentage of energetic particulates spatially distributed throughout an elastomeric binder which is based upon a thermoplastic, elastomeric ionomer.

Ionomers suitable for the invention are comprised of polymer molecules which have interior segments that are substantially non-polar and that are amorphous and elastomeric in the range of ambient temperatures and end segments which are ionic and which form ionic interactions in the range of ambient temperatures with ionic end segments of like polymer molecules. The ionomer may be a linear molecule having a non-polar amorphous central segment and a pair of ionic end segments. Preferably, however, for forming a three-dimensional network that provides the high-energy formula with excellent mechanical characteristics, it is preferred that the ionomer be a star-branched polymer having three or more branches with each branch of the star having an inner segment which is non-polar and amorphous and an end segment which is ionic. A variety of suitable star-branched polymers are described in publications and patent applications referenced above. The inner segments of the polymer molecules provide the elasticity required for many high-energy binder applications. The inner segments are amorphous at ambient temperatures, e.g., 20° C. and are preferably selected to remain amorphous at substantially lower temperatures, e.g., down to −40° C. and even down to −60° C. It is contemplated that rocket motors will be subjected to low temperature extremes, and the amorphous inner segments of the polymer molecules must provide elasticity at low temperature extremes. The ionic end segments, on the other hand, must maintain the three-dimensional structure of the ionomer throughout high-temperature extremes to which the composition might be subjected during storage, e.g., up to about 60° C. A feature of ionomers suitable for binder systems is that the amorphous, elastomeric segments may be much longer than the ionic end segments which may be the length of the residue of only one or a few monomer units. Typically, the amorphous units of each branch are residues of monomer units measuring ten or more times the monomer residues of the end segments.

In order that the short, ionic end segments provide sufficient ionic interaction between polymer molecules to maintain a three-dimensional structure, the end segments have relatively strongly ionic chemical groups, such as sulfonate, carboxylates, ammoniums and phosphates. The ionic interaction between ionomer molecules is a dynamic equilibrium process. At or near room temperature, the association-dissociation time scale is very long so that the cross-links due to ionic group interaction appear to be permanent. At elevated temperatures, the association-dissociation time scale is very short, allowing the ionic groups to "hop" from ionic cluster to ionic cluster, thereby permitting the material to flow under external shear stress. It is this ability to flow which gives the ionomers their thermoplastic characteristics. Even though ionomers may flow at elevated temperatures, the ionic interactions reduce the flow of high-energy compositions at high temperatures and may make it difficult or impossible to process high-energy compositions in conventional extruding, casting and extruding apparatus. Even at elevated temperatures, ionic groups of ionomer molecules interact with each other. Also, ionic groups of ionomer molecules interact with ionic particulate matter, e.g., ammonium perchlorate. Furthermore, due to the presence of high-energy particulates, such as ammonium perchlorate, there is a limit to the temperature at which high-energy compositions may be processed. Generally, the high-energy compositions having ionomeric binder systems must be processible in a temperature range of from about 70° C. to about 200° C., preferably in the range of 70° C. to about 120° C.

In accordance with an important aspect of this invention, the binder system contains an ionolyzer, which is a compound which acts to weaken, at elevated temperature, the ionic interactions of the ionomer molecules, both (a) between ionoic groups of different ionomer molecules and (b) between ionic groups of ionomer molecules and ionic groups of high-energy particulates. An ionolyzer for purposes of this invention is an ionic molecule which melts within the processing temperature range of the high-energy composition, i.e., 70° C. to 200° C., preferably 70° C. to 120° C., and in its molten state facilitates relative movement of ionomer molecules. The ionolyzer molecule may be selected from a broad range of chemical species, providing that the molecule is sufficiently polar and has an appropriate melting temperature. Generally, the molecules are low molecular weight, relative to the ionomer molecules, typically having molecular weights less than about 400. Examples of suitable ionolyzers are zinc stearate, stearamide (SA), octadecylamine, stearic acid, and mixtures thereof. At ambient and storage temperatures, the ionolyzers in their solid state do not interfere with ionic interactions of ionomer molecules, but at elevated temperature, the molten ionolyzers facilitate ionomer flow.

Further contributing to processability of high-energy, ionomer-based compositions is the inclusion in the binder system of hydrophobic plasticizers. Plasticizers are selected from compatibility with the inner, hydrophobic segments of the ionomer molecules. The plasticizers lubricate relative movement of the hydrophobic, elastomeric branch segments at processing temperatures. Furthermore, the plasticizers facilitate the elastomeric stretching and contraction of these segments at ambient and storage temperatures. Examples of suitable plasticizers include, but are not limited to hydrocarbon oil and low molecular diesters, such as dioctyl adipate, and mixtures thereof.

the processing temperature of the ionomer. Blending is done in conventional mixing apparatus, such as a Banbury mixture.

The invention will now be described in greater detail by way of specific examples.

EXAMPLES 1-6

Six propellant formulations were prepared having the compositions and physical properties given in the following table. Tufflo plasticizers are hydrocarbon oils.

IONOMER PROPELLANT MIXES

| | EXAMPLE | | | | | |
|---|---|---|---|---|---|---|
| | 1 | 2 | 3 | 4 | 5 | 6 |
| Ionomer | IE1025 3.7% | IE1025 3.7% | IE1025 3.0% | IE1025 3.5% | PIB 3.5% | PIB 4.0% |
| Plasticizer | Tufflo 500 10.0% | Tufflo 500 10.0% | Tufflo 6016 10.0% | Tufflo 6016 9.3% | Tufflo 6016 9.3% | Tufflo 6016 10.0% |
| Ionolyzer | Zn Stearate 1.3% | SA 1.3% | Zn Stearate 2.0% | Zn Stearate 0.6% SA 0.6% | Zn Stearate 1.2% | Zn Stearate 0.5% |
| Al, 30μ | — | — | — | 16.0 | 16.0 | 16.0 |
| AP, 200μ | 59.4 | 59.4 | 59.4 | 49.0 | 49.0 | 49.0 |
| AP, 20μ | 25.5 | 25.5 | 25.5 | 21.0 | 21.0 | 21.0 |
| Thermax | 0.1 | 0.1 | 0.1 | 0.0 | 0.0 | 0.0 |
| Bonding Agent | 0.0 | 0.0 | 0.0 | 0.0 | 0.0 | 0.0 |
| EOM Viscosity | 212 | 116 | 88 | 144 | 6.0 | 24.0 |
| Max Stress, psi | 62 | 23 | 54.2 | 63.4 | — | — |
| Strain at Max Stress, % | 22 | 15 | 29 | 33 | — | — |
| Strain at Rupture, % | 22 | 52 | 30 | 37 | — | — |
| Modulus, psi | 350 | 379 | 266 | 321 | — | — |

IE1025 = Commercial Ionomer
SA = Stearamide
PIB = Polyisobutylene

An important advantage of ionomers as the basis for high-energy compositions is that ionomers may be used at a very low weight percent relative to the total composition. Although an elastomeric binder is a necessary part of a high-energy composition, such as a propellant, the contribution of the elastomer to total energy of the composition is inherently quite low. Such compositions primarily derive their energy from solid particulates such as oxidizer particulates, e.g., ammonium perchlorate (AP), cyclotetramethylene tetranitramene (HMX) and cyclotrimethylene trinitramine (RDX), and fuel particulates, such as aluminum. High solids loading is therefore a much sought-after attribute of such compositions. Ionomers can be used at levels as low as 2.0 weight percent of the high-energy composition (20 weight percent of the binder system), although they may be used up to about 15 weight percent of the composition (50 weight percent of the binder system). The binder system typically comprises between about 10 and about 30 weight percent of the high-energy composition and the solids between about 70 and about 90 weight percent of the composition. The ionolyzer comprises between about 0.25 and about 6 weight percent of the composition (between about 2.5 and about 20 weight percent of the binder system). The hydrophobic plasticizer comprises between about 4 and about 24 weight percent of the composition (between about 40 and about 80 weight percent of the binder system).

In addition to the high-energy particulates and the components of the binder system, the high-energy composition may contain minor amounts of additional components known in the art, such as bonding agents, burn rate modifiers, etc.

To prepare high-energy compositions, the ionomers, ionolyzer, plasticizer, high-energy particulates and additional components are mixed at temperatures above While the invention has been described in terms of certain preferred embodiments modifications obvious to one with ordinary skill in the art may be made without departing from the scope of the invention.

Various features of the invention are recited in the following claims.

What is claimed is:

1. A high-energy composition comprising between about 70 and about 90 weight percent of solid particulates which are fuel particulates and/or oxidizer particulates and between about 10 and about 30 weight percent of a binder system, said solid particulates being distributed throughout a matrix of said binder system, said binder system comprising a star-branched telechelic ionomer having three or more branches, each branch having substantially non-polar hydrophobic amorphous inner segments and ionic outer chain ends, said ionomer comprising between about 2 and about 15 weight percent of said composition, an ionolyzer at between about 0.25 and about 6 weight percent of said composition and a hydrophobic plasticizer comprising between about 4 and about 24 weight percent of said composition.

2. A composition according to claim 1 wherein said ionolyzer melts at a temperature of between about 70° C. and about 120° C.

3. A composition according to claim 1 wherein said ionolyzer is selected from the group consisting of zinc stearate, stearamide, octadecylamine, stearic acid and mixtures thereof.

4. A composition according to claim 1 wherein said plasticizer is selected from the group consisting of hydrocarbon oils, low molecular esters, low molecular weight diesters and mixtures thereof.

5. A high-energy composition comprising between about 70 to about 90 weight percent of solid particulates which are fuel particulates and/or oxidizer particulates and between about 10 to about 30 weight percent of a binder system, said solid particulates being distributed throughout a matrix of said binder system, said binder system comprising:

(a) a thermoplatic, elastomeric star-branched telechelic ionomer having three or more branches, each branch having interior segments that are substantially non-polar, hydrophobic, amorphous and elastomeric at an ambient temperature of about 20° C. and ionic outer chain ends of one or more monomer units, said ionomer comprising between about 2 to about 15 weight percent of said composition, (b) an ionolyzer melting at a temperature of between about 70° C. and about 200° C. which in its molten state facilitates dissociation of ionic interaction between ionomer molecules and reduces the viscosity of the composition during mixing, casting or extrusion and which comprises between about 0.25 to about 6 weight percent of said composition, and (c) a hydrophobic plasticizer comprising between about 4 to about 24 weight percent of said composition.

6. A composition according to claim 5 wherein said ionolyzer melts at a temperature of between about 70° C. and about 120° C.

7. A composition according to claim 6 wherein said ionolyzer is selected from the group consisting of zinc stearate, stearamide, octadecylamine, stearic acid and mixtures thereof.

8. A composition according to claim 7 wherein said plasticizer is selected from the group consisting of hydrocarbon oils, low molecular esters, low molecular weight diesters and mixtures thereof.

9. A composition according to claim 5 wherein:

said ionolyzer melts at a temperature of between about 70° C. and about 120° C., said ionolyzer is selected from the group consisting of zinc stearate, stearamide, octadecylamine, stearic acid and mixtures thereof, said plasticizer is selected from the group consisting of hydrocarbon oils, low molecular esters, low molecular weight diesters and mixtures thereof.

10. A composition according to claim 1 wherein the amorphous inner segments of each branch are residues of monomer units measuring at least ten times the monomer units of the residues of the ionic outer chain ends.

11. A composition according to claim 5 wherein the amorphous inner segments of each branch are residues of monomer units measuring at least ten times the monomer units of the residues of the ionic outer chain ends.

12. A composition according to claim 9 wherein the amorphous inner segments of each branch are residues of monomer units measuring at least ten times the monomer units of the residues of the ionic outer chain ends.

* * * * *